US005891271A

United States Patent [19]

Yuki et al.

[11] Patent Number: 5,891,271

[45] Date of Patent: Apr. 6, 1999

[54] S-CONTAINING FE—NI ALLOYS FOR ELECTRON GUN PARTS AND PUNCHED ELECTRON GUN PARTS

[75] Inventors: Norio Yuki; Yoshihisa Kita, both of Kanagawa-ken, Japan

[73] Assignee: Nippon Mining & Metals Co., Ltd., Tokyo, Japan

[21] Appl. No.: 971,281

[22] Filed: Nov. 18, 1997

[30] Foreign Application Priority Data

Mar. 27, 1997 [JP] Japan ..... 9-091336

[51] Int. Cl.[6] ..... H01J 17/04; C22C 38/08; C22C 19/03

[52] U.S. Cl. ..... 148/331; 148/336; 148/426; 313/633

[58] Field of Search ..... 148/419, 442, 148/426, 427, 428, 429, 409, 336, 331; 313/633, 631

[56] References Cited

FOREIGN PATENT DOCUMENTS 4-231419 8/1992 Japan .
4-354853 12/1992 Japan .

*Primary Examiner*—Margery Phipps
*Attorney, Agent, or Firm*—Seidel, Gonda, Lavorgna & Monaco, PC

[57] ABSTRACT

Fe—Ni alloys for electron gun parts consisting of, all by weight, 30–55% Ni, 0.0010–0.200% S, up to 0.8% Mn, from not less than 0.005 to less than 0.5% in total of one or more elements selected from the group consisting of Ti, Mg, Ce and Ca, and the balance substantially Fe and unavoidable impurities, and electron gun parts, typically electron gun electrodes, made of the alloys by punching are provided. Controlling the grain size number to No. 7.0 or above is also effective. The Fe—Ni alloys of this invention for electron gun parts are remarkably improved in press punchability and can solve burring problems through the easy formation of sulfide inclusions of Ti, Mg, Ce, and Ca.

3 Claims, 1 Drawing Sheet

S-CONTAINING FE— NI ALLOYS FOR ELECTRON GUN PARTS AND PUNCHED ELECTRON GUN PARTS

BACKGROUND OF THE INVENTION

This invention relates to Fe—Ni alloys with improved press punchability which are suitable as materials for electron gun parts, such as electrodes for electron guns. The invention also relates to punched electron gun parts, typically electron gun electrodes, obtained by blanking a stock of such alloy and punching very small holes in the blanks for passage of electron beams therethrough.

FIG. 1 shows a cross section of a color picture tube of the shadow mask type already known in the art. A panel 1 is coated on the back side with a phosphor film 2 that generates the three primary colors of red, green, and blue. In the neck are housed electron guns 4 that emit electron beams 3. The electron beams 3 are deflected in scanning by a deflection yoke 5. The numerals 6 and 7 indicate a shadow mask and a magnetic shield, respectively.

FIGS. 2A and 2B are perspective and cross sectional (along line I—I' in FIG. 2(*a*)) views, respectively, of an electrode (grid electrode) 10 as an example of punched part to be fitted in the electron guns 4. The electrode 10 acts to control the thermionic emission of electrons from the cathodes in the electron guns, form electron beams, and modulate the flow rate of electrons. The electrode 10 has very small holes 10*a*, 10*b*, and 10*c* made by coining and punching so as to allow red, green, and blue color-generating beams, respectively, to pass through them.

In general, the electron gun parts for use in picture tubes and the like are completed by blanking and punching, with or without coining, a sheet of nonmagnetic stainless steel about 0.05 to 0.5 mm thick.

Nonmagnetic stainless steels are well-known materials in common use for electron gun parts of picture tubes and the like. In the manufacture of the electrode that accelerates the electrons emitted from the cathodes of electron guns, however, more weight has recently been put on lower thermal expansion coefficient than on nonmagnetic properties. With the advent of higher refinement, higher performance picture tubes for computer displays and the like in recent years, it has been noted that delicate dimensional changes with thermal expansion of electrode parts influence the quality of pictures (color purity) on the panel 1 (see FIG. 1). To cope with the situation, Fe—Ni alloys having low thermal expansion properties, notably Fe-42% Ni alloy (42 Alloy), have come into use as electrode materials. The 42 Alloy of the prior art, however, presents a burr problem. As blanks of the alloy for electrodes are punched with a pattern of very small holes 10*a*, 10*b*, and 10*c* each, the punching dies produce burrs B on the edges 10*e* of the holes where they have forced slugs down (see FIGS. 2A and 2B). The burrs that result from the punching not only have adverse effects upon the control of electron beams but also cause the emission of unwanted electron, both of which could be fatal defects for electron guns. The tendency toward a higher level of refinement of picture tubes is making the requirement for the reduction of burrs generated in electron gun parts more and more exacting.

Proposals for improving the punchability of Fe—Ni alloys have hitherto been made, for example, in Japanese Patent Application Kokai Nos. 6-184703, 6-122945, 7-3400, and 7-34199.

Of those proposals, Kokai No. 6-184703 specifies an S content in the range of 0.002 to 0.05% and disperses S or an S compound along grain boundaries or within grains in the alloy stock. However, the addition of S, a mere free-cutting element, in a specified percentage cannot be deemed adequate for the control of burrs to most precise specifications in the recent and future press working parts.

Kokai Nos. 6-122945, 7-3400, and 7-34199 propose adding such strengthening elements as Ti, Nb, V, Ta, W, or/and Zr to the alloy for sufficient hardness and proper embrittlement to suppress burring. The enhanced hardness, in turn, poses a problem of shortened punching die life.

This invention has for its object to settle the aforedescribed problems of the prior art and provide Fe—Ni alloys for electron gun parts improved in punchability without attendant shortening of die life, and also provide punched parts for electron guns, typically electron gun electrodes, made of the alloys by punching and having reduced burrs.

BRIEF SUMMARY OF THE INVENTION

The present inventors have intensively studied the composition of inclusions that influences the press punchability of Fe—Ni alloys. As a result, they have now successfully solved the above problems by controlling the composition of inclusions and improving the press punchability of Fe—Ni alloys for electron gun parts, through control of the S content and the proportions of Ti, Mg, Ce, and Ca as elements that easily form sulfide inclusions within specific ranges. Specifically, the research has now made it clear that the most effective inclusions for the enhancement of press punchability are sulfide inclusions. Research has further made it clear that the proportions and distribution of the sulfide inclusions do not depend solely upon the S content but are largely influenced by the Ti, Mg, Ce, and Ca content.

Thus the present invention can provide materials that can meet the exacting requirements against burring of electron gun parts by the addition of a proper amount of S combined with the addition of Ti, Mg, Ce, and Ca as elements that facilitate the formation of sulfide inclusions, their contents being controlled within specific ranges. According to the present invention, Ti, Mg, Ce, and Ca are added to the extent that they merely form sulfide inclusions that have slight hardening effects upon the alloy. There is no problem of shortened die life due to increased hardness of the material.

On the basis of these findings, this invention provides Fe—Ni alloys for electron gun parts consisting of, all by weight, from 30 to 55% Ni, from 0.0010 to 0.0200% S, 0.8% or less Mn, from more than 0.005 to less than 0.5% in total of one or two or more elements selected from the group consisting of Ti, Mg, Ce, and Ca, the balance being substantially Fe and unavoidable impurities. The invention also provides electron gun parts made of the alloys by punching.

It has also been found that controlling the grain size to No. 7.0 or above in austenite grain size number according to JIS G0551 is effective. The invention, therefore, provides Fe—Ni alloys for electron gun parts comprising, all by weight, from 30 to 55% Ni, from 0.0010 to 0.0200% S, 0.8% or less Mn, from more than 0.005 to less than 0.5% in total of one or two or more elements selected from the group consisting of Ti, Mg, Ce, and Ca, and the balance substantially Fe and unavoidable impurities, said alloy having a grain size of No. 7.0 or above in austenite grain size number according to JIS G0551. The invention also provides electron gun parts made of the alloys by punching.

Typical of the electron gun parts made of the alloys by punching are electron gun electrodes such as grid electrodes.

DETAILED DESCRIPTION OF THE INVENTION

Figure 1:
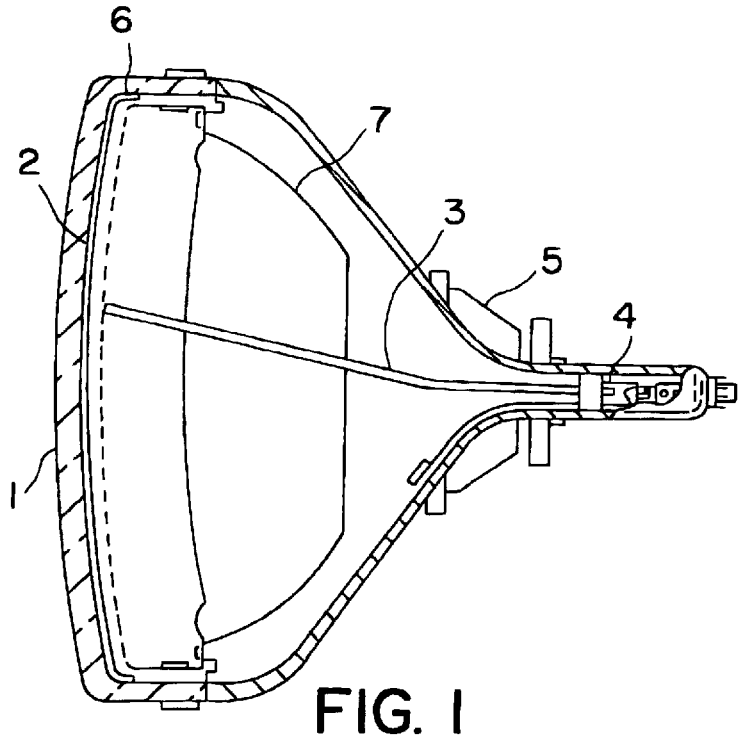
FIG. 1 is a cross sectional view of a shadow mask type picture tube.
Figure 2A:
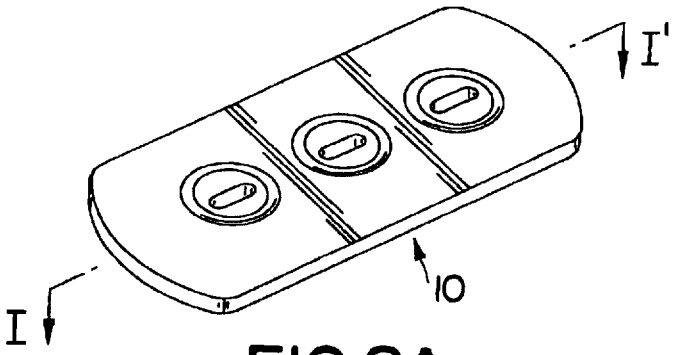
FIG. 2A shows, in a perspective view, an electrode for an electron gun as an example of a punched part according to this invention.
Figure 2B:
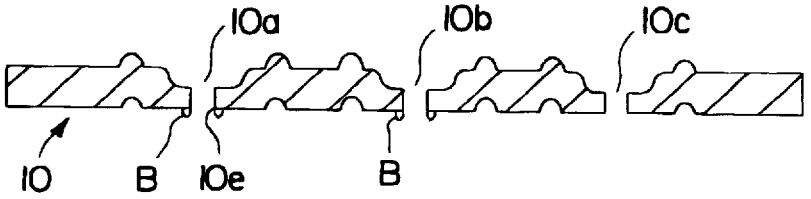
FIG. 2B shows, in a cross sectional view, an electrode for an electron gun as an example of a punched part according to this invention.

The reasons for limiting the numerical ranges of the alloying elements in conformity with this invention will now be explained.

(Ni):-Ni is an important element that determines the thermal expansion properties of an Fe—Ni alloy. If its proportion is less than 30% or more than 55%, the alloy is undesirable, having a thermal expansion coefficient which is too high. Hence the Ni content is restricted in the range of 30 to 55%.

(S):-S, together with Mn or with Ti, Mg, Ce, and Ca, forms sulfide inclusions that help improve the punchability of the alloy. Its proper range depends on the proportions of other sulfide-forming elements, but at least 0.0010% is necessary, while its effectiveness is almost constant beyond 0.0200%. For these reasons the S content is set within 0.0010 to 0.0200%.

(Mn):-Mn combines with S to form MnS that improves punchability. The presence of Mn is not particularly important, however, because the invention adds to the alloy at least one of elements chosen from among Ti, Mg, Ce, and Ca that more readily form sulfides than Mn. The Mn content is limited to 0.8%, because in excess of 0.8%, Mn readily combines with inevitably remaining oxygen to form unwanted oxide inclusions.

(Ti, Mg, Ce, Ca):Ti, Mg, Ce, and Ca are the elements which form sulfides more easily than Mn. They form sulfide inclusions in an alloy to improve alloy punchability. They exhibit effectiveness in a smaller amount than Mn. One or two or more of Ti, Mg, Ce or Ca in a total amount of more than 0.005% enhances punching properties. However, the addition of more than 0.5% will not increase the effect. The alloy becomes saturated and more Ti, Mg, Ce or Ca will merely add to the cost. Hence the upper limit of there elements, in total, is 0.5%.

The remainder of the alloy is accounted for by unavoidable impurities and Fe. The impurities are those normally contained, including C, P, Cr, and Co. They have adverse effects upon thermal expansion properties, and the total content of these impurity elements desirably ranges from about 10 to 2000 ppm.

As for the grain size, No. 7.0 or above in austenite grain size number properly controls the ductility of the matrix and makes the alloy suited for punching. The grain size No. is determined according to the grain size testing method described in JIS G-0551. "JIS" means "Japanese Industrial Standard". Standards issued by the Japanese Industrial Standard Committee cover industrial products. According to the text of JIS G0551, the austenite grain size number "N" is related to the number of grains "n" per 1 $mm^2$ cross section of a material by the relationship: $n=2^{N+3}$. When N is 7.0, the value of n is, 1024, that is there are 1024 grains per 1 $mm^2$ cross section.

The inventors have analyzed in detail the process of shear deformation and ensuing ductile fracture during the course of punching. The research has just revealed that it is important for minimizing burrs that, during a punching operation, not only the fracture onsets from the inclusions as starting points as is commonly accepted, but also the resulting cracks, should propagate rapidly. For the propagation of the cracks, sulfide inclusions rather than oxide inclusions have been found effective.

Moreover, the effect of S in this invention is, contrary to the general belief, not upon the improvement of the free cutting property, or a lubricating effect by S. According to this invention, sulfide inclusions are related to the propagation of cracks upon ductile fracture in the shear zone. Thus, compared with the S content required for improving the free cutting property, the amount of S needed for the desired effect in this invention is small.

The invention has now made it possible for the first time to provide materials that can meet exacting requirements against burrs in electron gun parts, by dispersing a proper amount of sulfide inclusions in the materials.

Where a deoxidizing element such as Si or Al is used, it is advisable to limit the Si content to 0.3% or Al to 0.05% in order to minimize the residual amount of unwanted oxide inclusions. Oxygen too should be limited to less than 0.005% so as to reduce the residual oxide inclusion amount.

The manufacturing process is as follows. An Fe—Ni alloy ingot or continuously cast slab is obtained by melting the component materials in the specified proportions. The ingot or slab is hot rolled with or without prior forging, and repeatedly annealed and cold rolled to a final thickness. After final annealing, the ingot or slab is finished to be a sheet stock about 0.05 to 0.5 mm thick to be punched. Proper control of the final annealing conditions to a grain size number of No. 7.0 or above gives better results. Electron gun parts are completed by directly punching the stock on a punch press, or after coining operation.

EXAMPLES

The invention is illustrated by the following Examples and Comparative Examples.

Fe—Ni alloys composed mainly of Fe and 42% Ni were melted to form ingots weighing about 6 kg each by vacuum induction melting. As the raw materials, electrolytic Fe, electrolytic Ni, electrolytic Mn, metallic Ti, Ni—Mg master alloy, Ni—Ce master alloy, and Ni—Ca master alloy were used. The S content was adjusted by the addition of Fe—S (iron sulfide).

Each ingot was hot rolled at 1200° C. to a 4 mm-thick plate. The plate was annealed, pickled, and cold rolled to a thickness of 1.5 mm. It was then annealed and cold rolled to a sheet 0.5 mm thick. Next, the sheet was annealed in vacuum at 750° C. for one hour to give a test material.

Punchability was evaluated in the following way: Each test material was coined to a thickness of 0.28 mm, punched to provide a total of 10 holes 0.4 mm in diameter, and the maximum height of burrs that resulted from the punching was measured. The fracture surface ratio of the punched surface was also measured. Investigations by the inventors on punching properties revealed that the greater the fracture surface ratio the higher the burr height. TABLE 1 shows the chemical compositions of the alloy stocks and maximum burr heights and fracture surface ratios of specimens according to Examples and Comparative Examples.

The term "burr height" as used herein means the distance (length of projection) of the outer end of a burr from the under side of a punched hole as viewed in a cross section of the hole. The "fracture surface ratio (%)" is defined to be:

(Fracture surface thickness/sheet thickness)×100.

TABLE 1

| No. | Chemical composition (wt %) Ni | S | Mn | Additional element | Fe | Grain size Number | Maximum burr height (μm) | Fracture surface ratio (%) |
|---|---|---|---|---|---|---|---|---|
| 1 | 41.6 | 0.0018 | 0.12 | Ti: 0.08 | balance | 9.5 | 3 | 31.4 |
| 2 | 41.0 | 0.0015 | 0.18 | Mg: 0.02 | balance | 9.0 | 3 | 31.1 |
| 3 | 40.8 | 0.0014 | 0.34 | Ce: 0.007 | balance | 8.5 | 3 | 30.4 |
| 4 | 40.9 | 0.0021 | 0.54 | Ca: 0.03 | balance | 9.5 | 3 | 31.5 |
| 5 | 41.7 | 0.0072 | 0.08 | Ti: 0.24 | balance | 10.0 | 1 | 34.8 |
| 6 | 41.7 | 0.0072 | 0.08 | Ti: 0.24 | balance | 6.0 | 3 | 31.7 |
| 7 | 40.7 | 0.0086 | 0.14 | Ce: 0.13 | balance | 9.5 | 2 | 32.5 |
| 8 | 41.2 | 0.0120 | 0.22 | Ti: 0.18, Ca: 0.07 | balance | 10.5 | 1 | 35.6 |
| 9 | 41.4 | 0.0176 | 0.07 | Ti: 0.34, Ca: 0.11 | balance | 10.5 | 1 | 36.3 |
| 10 | 40.9 | 0.0005 | 0.16 | — | balance | 9.0 | 8 | 19.8 |
| 11 | 41.0 | 0.0012 | 0.07 | Ti: 0.002 | balance | 9.0 | 7 | 21.4 |
| 12 | 41.1 | 0.0015 | 0.05 | Mg: 0.003 | balance | 9.0 | 8 | 20.2 |
| 13 | 40.9 | 0.0016 | 0.08 | Ce: 0.001 | balance | 8.5 | 8 | 21.7 |
| 14 | 41.3 | 0.0013 | 0.05 | Ca: 0.002 | balance | 9.0 | 7 | 21.2 |

Nos. 1–9: Examples of this invention
Nos. 10–14: Comparative Examples

As can be seen from TABLE 1, all the specimens in the Examples of the invention were superior in punchability to the specimens of the Comparative Examples, with smaller maximum burr heights and higher fracture surface ratios. The maximum burr height was only 3 μm.

Comparative Example 10 contained S in an amount outside the range specified according to the present invention. Comparative Examples 11 to 14 contained an additional element of Ti, Mg, Ce, or Ca in a lesser amount outside the range of the present invention. They therefore exhibited no effect of addition, and showed high maximum burr heights, small fracture surface ratios, and inferior punchability.

Among the Examples of the present invention, Example 5 having a grain size number of more than No. 7.0 showed a smaller maximum burr height and a higher fracture surface ratio than Example 6 which had the same composition but a grain size of less than 7.0.

As has been described above, the Fe—Ni alloys of the present invention for electron gun parts are remarkably improved in press punchability. They can solve burring problems that are fatal to electron gun parts. The Fe—Ni; alloys of the invention produce excellent electron gun parts capable of keeping pace with the development of higher quality picture tubes.

We claim:

1. An Fe—Ni alloy for electron gun parts consisting essentially of, all by weight, from 30 to 55% Ni, from 0.0072 to 0.0200% S, 0.8% or less Mn, from no less than 0.005 to less than 0.5% in total of one or more elements selected from the group consisting of Ti, Mg, Ce, and Ca, and the balance Fe and unavoidable impurities, said alloy having a grain size number of No. 7.0 or above in austenite grain size number according to JIS G0551.

2. A punched electron gun part of an Fe—Ni alloy consisting essentially of, all by weight, from 30 to 55% Ni, from 0.0072 to 0.0200% S, 0.8% or less Mn, from no less than 0.005 to less than 0.5% in total of one or more elements selected from the group consisting of Ti, Mg, Ce, and Ca, and the balance substantially Fe and unavoidable impurities, said alloy having a grain size of No. 7.0 or above in austenite grain size number according to JIS G0551.

3. An electron gun electrode of an Fe—Ni alloy consisting essentially of, all by weight, from 30 to 55% Ni, from 0.0072 to 0.0200% S, 0.8% or less Mn, from no less than 0.005 to less than 0.5% in total of one or more elements selected from the group consisting of Ti, Mg, Ce, and Ca, and the balance substantially Fe and unavoidable impurities, said alloy having a grain size of No. 7.0 or above in austenite grain size number according to JIS G0551.

* * * * *